US012616293B2

(12) United States Patent
Pefley et al.

(10) Patent No.: US 12,616,293 B2
(45) Date of Patent: May 5, 2026

(54) SMART STRAP FOR CARRYING UNWIELDY OBJECTS

(71) Applicant: D&T Products, LLC, Minden, NV (US)

(72) Inventors: Troy Pefley, Fernley, NV (US); Dustin Pefley, Fernley, NV (US)

(73) Assignee: D&T Products, LLC, Minden, NV (US)

( * ) Notice: Subject to any disclaimer, the term of this patent is extended or adjusted under 35 U.S.C. 154(b) by 114 days.

(21) Appl. No.: 17/895,134

(22) Filed: Aug. 25, 2022

(65) Prior Publication Data

US 2023/0022250 A1 Jan. 26, 2023

Related U.S. Application Data

(63) Continuation-in-part of application No. 17/385,304, filed on Jul. 26, 2021, now abandoned.

(51) Int. Cl.
*A45F 3/14* (2006.01)

(52) U.S. Cl.
CPC ..... *A45F 3/14* (2013.01); *A45F 2003/142* (2013.01); *A45F 2003/146* (2013.01)

(58) Field of Classification Search
CPC ..... A45F 3/14
USPC ..... 224/627, 259
See application file for complete search history.

(56) References Cited

U.S. PATENT DOCUMENTS 995,458 A * 6/1911 Harriman ..... A45F 3/06 224/645
4,739,913 A * 4/1988 Moore ..... A62B 9/04 224/652
5,579,966 A * 12/1996 Krumweide ..... A45F 3/08 294/157
5,803,332 A * 9/1998 Thompson ..... A45F 3/04 224/580
5,918,785 A * 7/1999 Irose ..... G10G 7/005 294/157
6,135,334 A * 10/2000 Seichter ..... A45F 3/08 224/630
6,347,730 B1 * 2/2002 Frederick ..... A45F 5/12 294/157
6,607,107 B2 * 8/2003 Dexheimer ..... A45F 3/04 224/604
6,655,564 B1 * 12/2003 Zupan ..... A45F 5/12 224/604

(Continued)

*Primary Examiner* — Nathan J Newhouse
*Assistant Examiner* — Lester L Vanterpool
(74) *Attorney, Agent, or Firm* — Mark A. Goodman; Goodman Law Center, P.C.

(57) ABSTRACT

Several strap apparatuses employing different strap configurations for securing unwieldy objects are disclosed herein. Strap apparatus embodiments can employ a fulcrum with a plurality of straps attached to the fulcrum. For example, an embodiment can include four straps attached to the fulcrum at the corners using D-clips and stitching. Straps can be interconnected using buckle fasteners and tightened using cinch clips or other means. Another embodiment can include straps with enlarged ends that can be attached to the fulcrum through openings. Handles can be attached to the straps to (Continued)

enable a user to adjust the straps for carrying an unwieldy object. Cross straps can be included to further secure the apparatus during transport of an object.

5 Claims, 13 Drawing Sheets

(56) References Cited

U.S. PATENT DOCUMENTS 6,889,882 B1 * 5/2005 Leep ..... A45F 3/14 224/160
7,131,534 B2 * 11/2006 Enes ..... A45F 3/14 206/315.3
D591,008 S * 4/2009 Barringer ..... D30/133
7,971,764 B2 * 7/2011 Sabbah ..... A45F 5/00 224/652
8,118,201 B1 * 2/2012 Calkin ..... A45F 3/047 224/655
8,348,114 B2 * 1/2013 Gleason, Jr. ..... A45F 3/08 224/633
8,381,956 B2 * 2/2013 Gleason, Jr. ..... A45F 3/047 224/645
8,496,149 B1 * 7/2013 Sohm ..... A45F 3/14 224/636
9,061,173 B1 * 6/2015 Felkel ..... A63B 69/0059
9,295,318 B2 * 3/2016 Fischer ..... A45F 3/16
10,251,466 B2 * 4/2019 Soltez ..... A45F 3/04
10,842,244 B2 * 11/2020 Ogrin ..... G09F 21/026
11,110,307 B1 * 9/2021 Possible ..... A62B 25/00
11,524,203 B2 * 12/2022 Davis ..... A63B 23/03541
11,759,689 B2 * 9/2023 Jordan ..... A63B 21/4021 482/124
2005/0107222 A1 * 5/2005 Toven ..... A63B 69/0059 482/91
2010/0224660 A1 * 9/2010 Gleason ..... A45F 3/00 224/264
2011/0259934 A1 * 10/2011 O'Ryan ..... A45F 3/10 224/627
2013/0043291 A1 * 2/2013 Davis, Jr. ..... A45F 3/15 224/272
2015/0366357 A1 * 12/2015 Nelson ..... A47C 1/14 224/155

* cited by examiner

SMART STRAP FOR CARRYING UNWIELDY OBJECTS

CROSS-REFERENCE TO RELATED APPLICATIONS

The present application is a continuation-in-part of U.S. patent application Ser. No. 17/385,304 filed 26 Jul. 2021.

BACKGROUND OF THE INVENTION

1. Field of the Invention

The present invention relates generally to strap apparatuses. More particularly, the present invention relates to strap apparatuses for use in carrying unwieldy objects.

2. Description of Related Art

For workers and other people who frequently carry unwieldy objects, it is often difficult and time consuming. For example, objects that cannot be carried by one person often require two or three people. If a person uses straps or a harness to tightly secure an object to their body, it can be dangerous during transport. If the person is traveling on stairs or on a hazardous surface and the person falls, the harnessed object may stay attached to the person and create another hazard during the fall. Thus, current strap systems are insufficient for enabling a person to transport an unwieldy object and readily release the object. There is a need in the field for an improved strap apparatus and method for securing and carrying unwieldy objects.

SUMMARY OF THE INVENTION

Several strap apparatuses employing different strap configurations for securing unwieldy objects are disclosed herein. Strap apparatus embodiments can employ a fulcrum with a plurality of straps attached to the fulcrum. For example, an embodiment can include four straps attached to the fulcrum at the corners using D-clips and stitching. Straps can be interconnected using buckle fasteners and tightened using cinch clips or other means. Another embodiment can include straps with enlarged ends that can be attached to the fulcrum through openings. Handles can be attached to the straps to enable a user to adjust the straps for carrying an unwieldy object. Cross straps can be included to further secure the apparatus during transport of an object.

A method of carrying an unwieldy object includes placing the object on a fulcrum prior to mounting on a user's back. The unwieldy object is positioned and balanced on a user's back between the fulcrum and the user. The user can manually adjust the straps as needed to securely transport the object. When the user wants to release the object, he can do so quickly by releasing the straps.

These and other features and advantages will be apparent from reading of the following detailed description and review of the associated drawings. It is to be understood that both the forgoing general description and the following detailed description are explanatory and do not restrict aspects as claimed.

DETAILED DESCRIPTION OF EMBODIMENTS

The following descriptions relate principally to preferred embodiments while a few alternative embodiments may also be referenced on occasion, although it should be understood that many other alternative embodiments would also fall within the scope of the invention. The embodiments disclosed are not to be construed as describing limits to the invention, whereas the broader scope of the invention should instead be considered with reference to the claims, which may be now appended or may later be added or amended in this or related applications. Unless indicated otherwise, it is to be understood that terms used in these descriptions generally have the same meanings as those that would be understood by persons of ordinary skill in the art. It should also be understood that terms used are generally intended to have the ordinary meanings that would be understood within the context of the related art, and they generally should not be restricted to formal or ideal definitions, conceptually encompassing equivalents, unless and only to the extent that a particular context clearly requires otherwise.

For purposes of these descriptions, a few wording simplifications should also be understood as universal, except to the extent otherwise clarified in a particular context either in the specification or in particular claims. The use of the term "or" should be understood as referring to alternatives, although it is generally used to mean "and/or" unless explicitly indicated to refer to alternatives only, or unless the alternatives are inherently mutually exclusive. Furthermore, unless explicitly dictated by the language, the term "and" may be interpreted as "or" in some instances. When referencing values, the term "about" may be used to indicate an approximate value, generally one that could be read as being that value plus or minus half of the value. "A" or "an" and the like may mean one or more, unless clearly indicated otherwise. Such "one or more" meanings are most especially intended when references are made in conjunction with open-ended words such as "having," "comprising" or "including." Likewise, "another" object may mean at least a second object or more. Thus, in the context of this specification, the term "comprising" is used in an inclusive sense and thus should be understood as meaning "including, but not limited to." As used herein, the use of "may" or "may be" indicates that a modified term is appropriate, capable, or suitable for an indicated capacity, function, or usage, while considering that in some circumstances the modified term may sometimes not be appropriate, capable, or suitable. "Plurality" is defined as more than one when used to describe a quantity in the description and claims.

Figure 1:
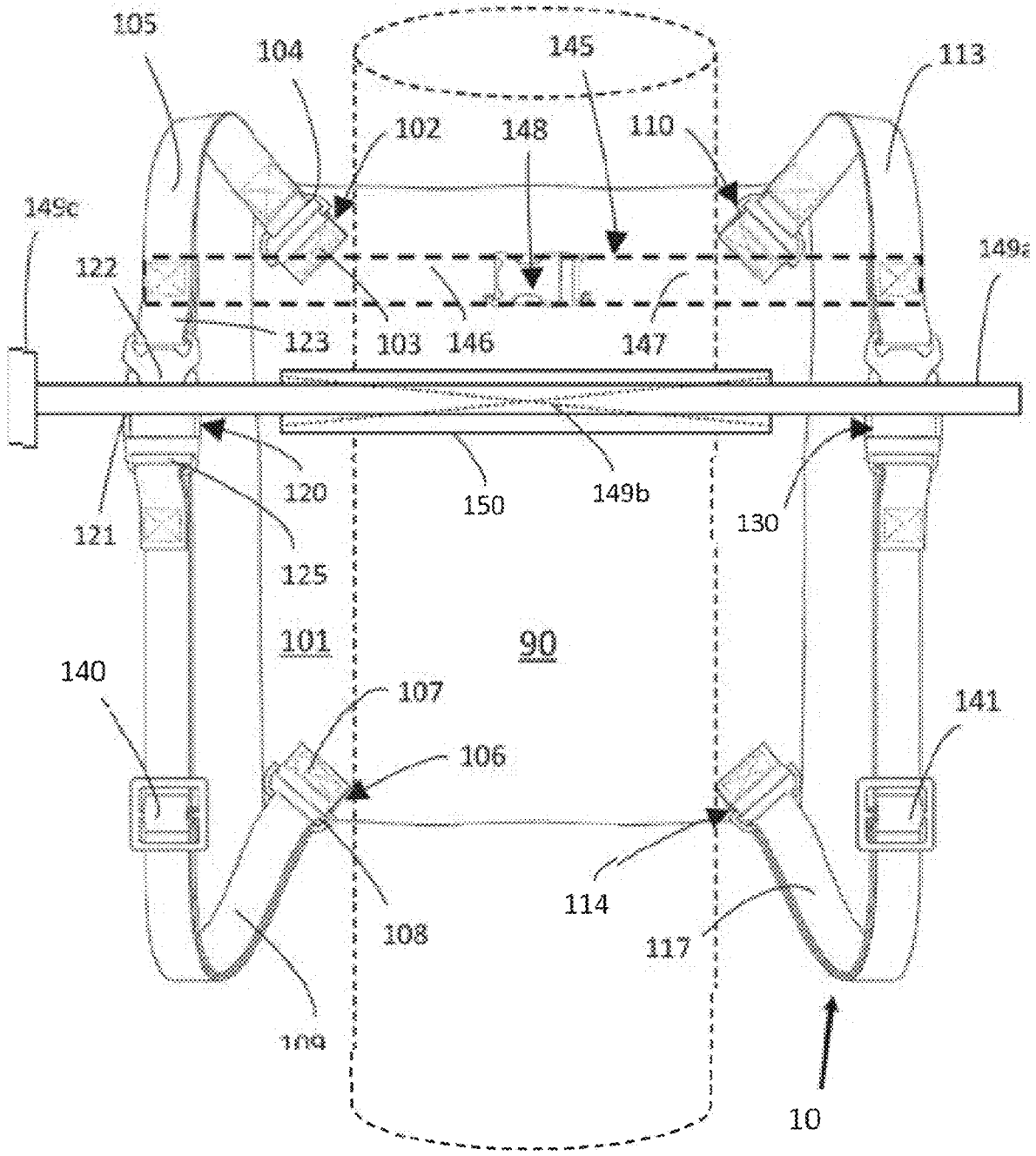
FIG. 1 illustrates a strap apparatus embodiment implementing four straps for carrying an unwieldy object.

FIG. 1 illustrates a strap apparatus embodiment 10 implementing four straps for carrying an unwieldy object. An "unwieldy object" can include a wide variety of items that are difficult to manually carry. The main body of the strap apparatus 10 includes a pivot point ("fulcrum") 101. In this embodiment 10, the fulcrum 101 is rectangular shaped but other shapes can be implemented included oval or circular. The fulcrum is preferably made of a flexible material such as nylon or other polymers. The fulcrum 101 includes a plurality of attachment points located at each corner. Referring to the first attachment point 102, a section of webbing 103 is sewn to the fulcrum 101. The attachment point further includes a D-ring 104 connected to the webbing 103. A first strap 105 is connected to another side of the D-ring 104. As shown, the D-ring 104 can be looped through both the webbing 103 and the first strap 105. In a similar manner to the first attachment point 102, a second attachment point 106 includes webbing 107 and a D-ring 108 connected to the webbing 107. Further, a second strap 109 is connected to another side of the D-ring 108. Additionally, a third attachment point 110 with a third strap 113, and a fourth attachment point 114 with a fourth strap 117 can be connected by similar means. In an alternative embodiment, the first strap 105 can be affixed directly to the first attachment point 102 using stitching without having D-rings, with the other straps 109, 113, 117 also connecting to their respective attachment points 106, 110, 114 without D-rings.

As shown in FIG. 1, the first strap 105 is operatively connected to the second strap 109 using a fastener 120. In this embodiment 10, the fastener 120 is a buckle fastener with a male connector 121 and female connector 122. Further, the fastener 120 has a first opening 123 allowing the first strap 105 to pass ("loop") through. Similarly, the fastener 120 has a second opening 125 allowing the second strap 109 to pass through. Further, the third strap 113 and fourth strap 117 can be operatively connected using a fastener 130 and secured by similar mechanisms as the first strap 105 and second strap 109. In addition, the straps 109, 117 can be tightened or loosened manually using fasteners 140, 141 such as cinch clips and the like. Another option is to include a pulley mechanism 145 for additional support of the strap apparatus 10. The pulley mechanism 145 in this example includes two cross straps 146, 147 and a fastener 148 connecting the cross straps. The cross straps 146, 147 can be affixed to the first strap 105 and third strap 113 using stitching, rivets, or other means. A user can optionally use the fastener 148 to secure the cross straps 146, 147 across the user's chest. The cross straps 146, 147 can easily be disengaged when the user wants to release the unwieldy object. Included in the apparatus 10 is a cinch strap 149*a* that acts as a cinch to lock the fulcrum 101 to the object 90. Further, a fulcrum strap 150 is affixed (e.g. stitched) to the fulcrum 101 and has a loop fastener (e.g. Velcro®). The cinch strap 149*a* with hook fastener 149*b* stitched to it runs through the 149*c* cinch loop and is mechanically fastened (connected) to the fulcrum strap 150 with its loop fastener.

A method of securing an unwieldy object 90 includes placing the object 90 on the strap apparatus 10 prior to transport. Preferably, the center of mass of an unwieldy object 90 is placed on the fulcrum 101. Centering the mass is important for providing balance and stability during transport of the object 90. The fulcrum 101 is shown positioned on a side of an unwieldy object 90 to provide support. The cinch strap 149*a* is wrapped all the way around the object 90 to lock the fulcrum 101 to the object 90.

Figure 2:
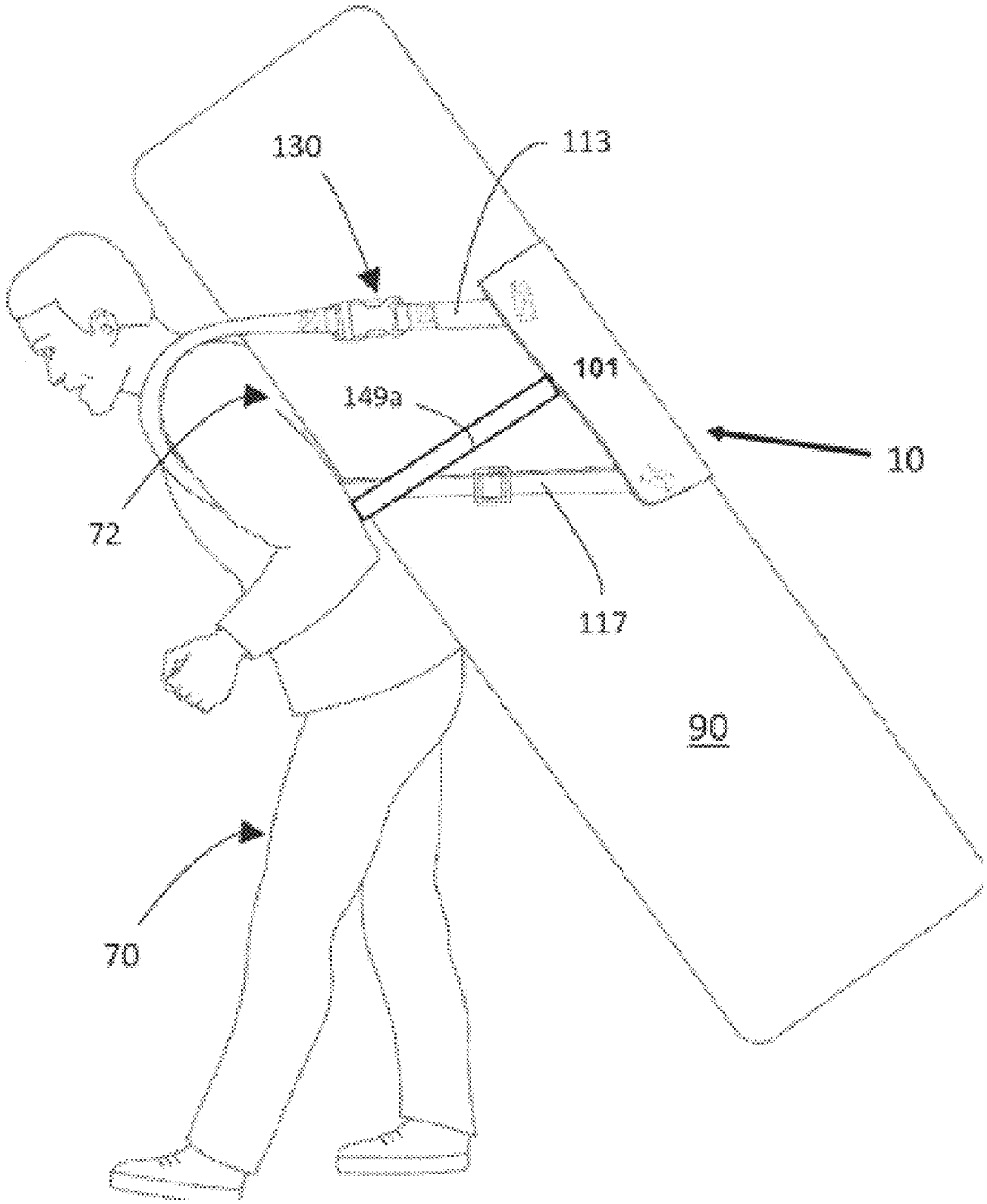
FIG. 2 illustrates a user employing a strap apparatus embodiment to carry an unwieldy object.

FIG. 2 illustrates a user 70 employing a strap apparatus embodiment 10 to carry an unwieldy object 90. In this example, the unwieldy object 90 is a roll of carpet. Once the unwieldy object 90 is placed in position on the fulcrum 101 and secured using the cinch strap 149*a*, the object 90 and apparatus 10 can be mounted on a user's back. The unwieldy object 90 is positioned on a user's back 72 between the fulcrum 101 and the user 70. The user 70 can manually adjust the straps 105, 109, 113, 117 as needed to securely transport the unwieldy object 90. When the user 70 wants to release the object 90, he can do so quickly by releasing the straps.

Figure 3:
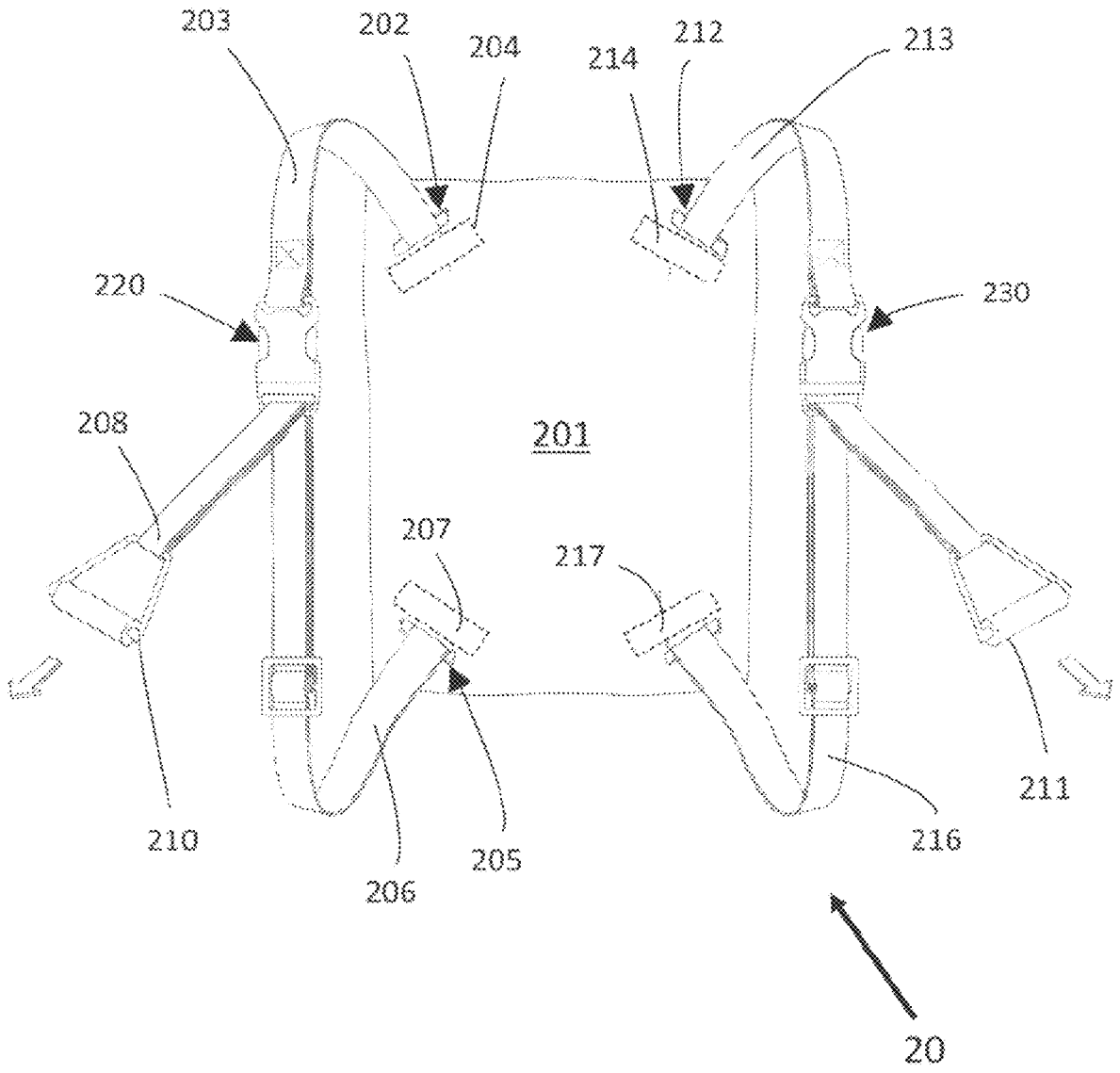
FIG. 3 illustrates an alternative strap apparatus embodiment implementing four straps for carrying an unwieldy object.

FIG. 3 illustrates an alternative strap apparatus embodiment 20 implementing four straps for carrying an unwieldy object. The main body of the strap apparatus 20 includes a fulcrum 201. In this embodiment 20, the fulcrum 201 is also rectangular shaped but other shapes can be implemented. The attachment points are openings enabling straps to pass through. Referring to the first attachment point (opening) 202, a first strap 203 can pass through the opening 202. The first strap 203 can have a larger end piece 204 which can be folded and manually pushed through the first opening 202. If tension is applied to the first strap 203, the larger end piece 204 will "catch" on part of the fulcrum 201 enabling the first strap 203 to remain engaged at the first attachment point 202. To disengage the first strap 203 from the first attachment point 202, a user can manually fold and push the end piece 204 back through the first opening 202. Similar to the first strap 203, a second strap 206 can have a larger end piece 207 which can be folded and manually pushed through the second opening 205. The end piece 207 will catch on part of the fulcrum 201 enabling the second strap 206 to remain engaged when tension is applied.

As shown in FIG. 3, the first strap 203 is operatively connected to the second strap 206 using a fastener 220. In this embodiment 20, the fastener 220 is a buckle fastener but other fasteners can be employed. A first handle 210 can be attached to an end 208 of the second strap 206. The first handle 210 enables a user to readily pull the second strap 206 as needed to tighten and secure an unwieldy object 90. Further, a third strap 213 and fourth strap 216 can be operatively connected using a fastener 230 and secured by similar mechanisms as the first strap 203 and second strap 206. A second handle 211 can be attached to an end 217 of the fourth strap 216 to further tighten and secure an unwieldy object. Another option is to include a pulley mechanism for additional support of the strap apparatus 20, similar to the pulley mechanism 145 shown in FIG. 1 regarding the strap apparatus embodiment 10.

Figure 4:
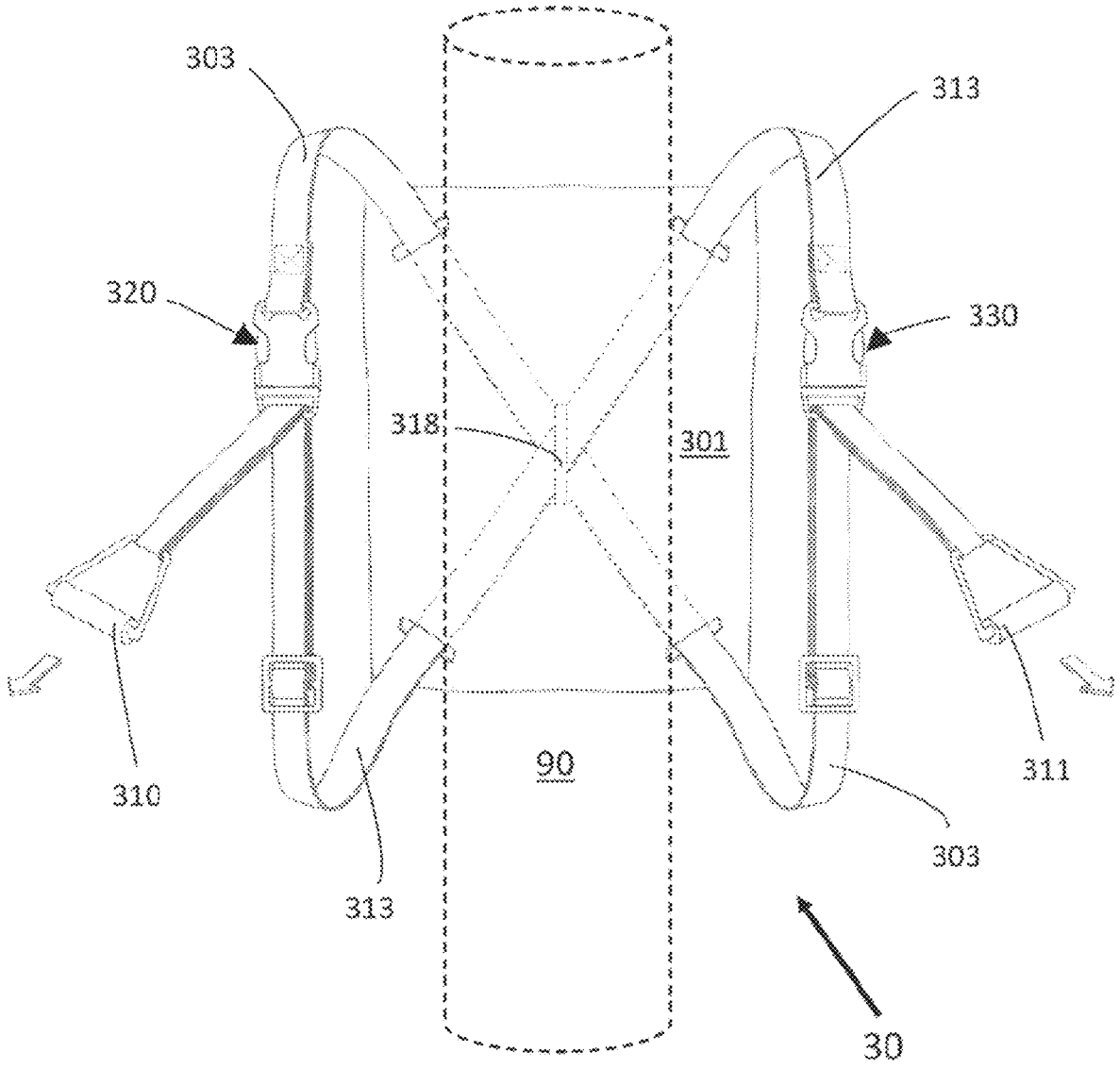
FIG. 4 illustrates a front view of an alternative strap apparatus embodiment implementing two straps that intersect and resemble a figure-eight shape.

FIG. 4 illustrates a front view of an alternative strap apparatus embodiment 30 implementing two straps that intersect and resemble a figure-eight shape. The fulcrum 301 has four attachment points (openings) for the straps 303, 313 but also has an intersection point 318. The intersection point 318 is stationary and preferably centered on the fulcrum 301. The straps 303, 313 and intersection point 318 are shown in broken lines to indicate that they are located on the opposite (rear) side of the fulcrum 301. The intersection point 320 keeps the straps 303, 313 together and provides stability to the strap apparatus 30 when the fulcrum 301 is positioned on a side of an unwieldy object (e.g. object 90 shown in FIG. 2) for transport. An upper portion of the first strap 303 is shown overlapping a lower portion of the second strap 313. The straps 303, 313 are affixed together at the intersection point 320. The intersection point 320 can be affixed to the fulcrum 301 by a variety of means such as shrinkable rubber, stitching, ties, rivets, and the like. Straps 303, 313 can be connected using a fastener 320 on one side of the fulcrum 301 and a fastener 330 on another side of the fulcrum 301. Handles 310, 311 can be optionally included for tightening and securing an unwieldy object 90. Another option is to include a pulley mechanism for additional support, similar to the pulley mechanism 145 shown in FIG. 1 regarding the strap apparatus embodiment 10.

Figure 5:
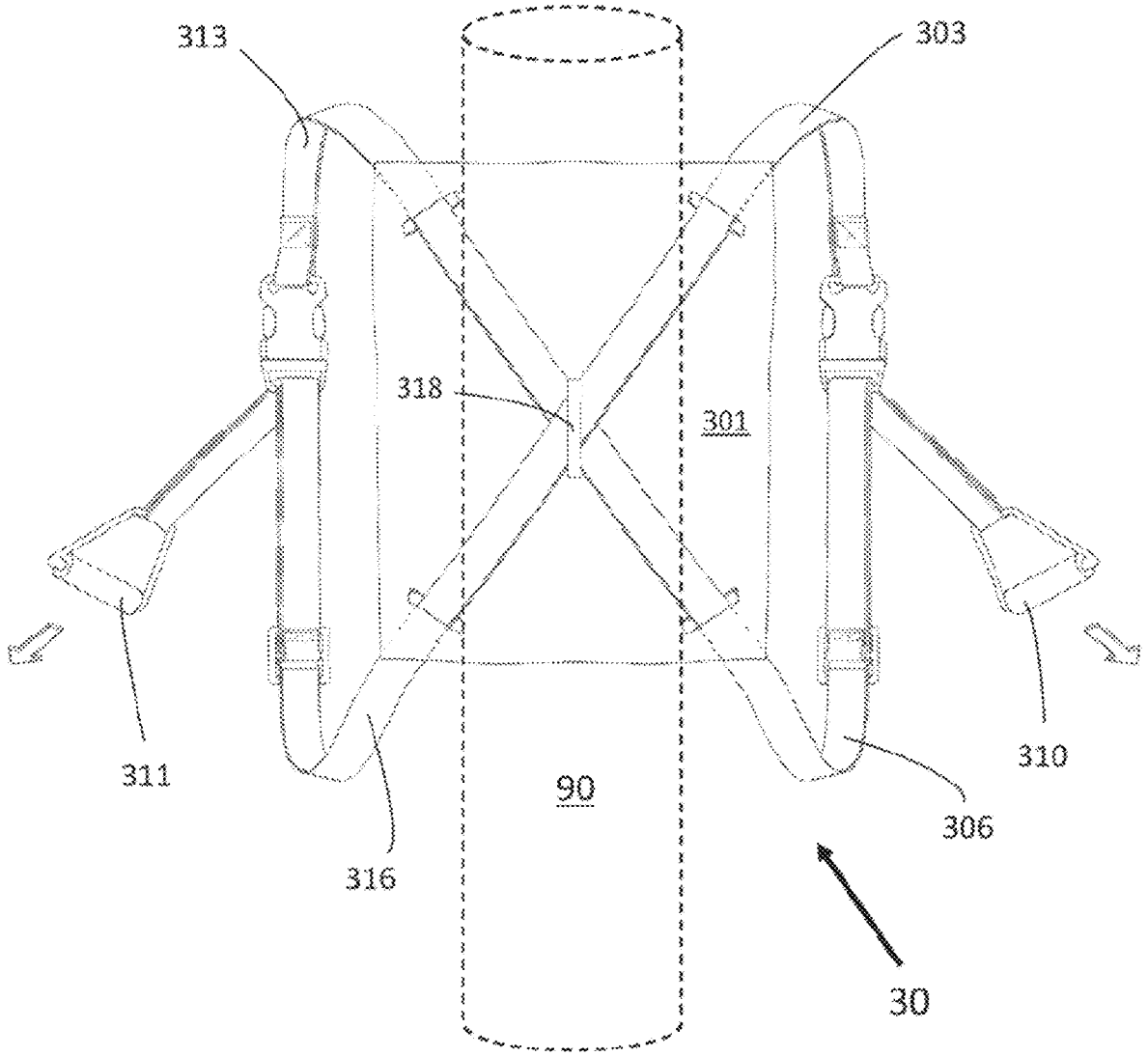
FIG. 5 illustrates a rear view of the alternative strap apparatus embodiment implementing two straps that intersect and resemble a figure-eight shape.

FIG. 5 illustrates a rear view of the alternative strap apparatus embodiment 30 implementing two straps that intersect and resemble a figure-eight shape. The straps 303, 313 can be manually tightened and loosened by a user as in other embodiments. The primary difference in the figure-eight embodiment 30 is the stationary intersection point 318 which secures the straps and improves stability of the apparatus 30. When a user pulls on a strap (e.g. 303) on one side of their body, the strap 303 will also tighten on the opposite body side because the strap 303 crosses sides.

Figure 6:
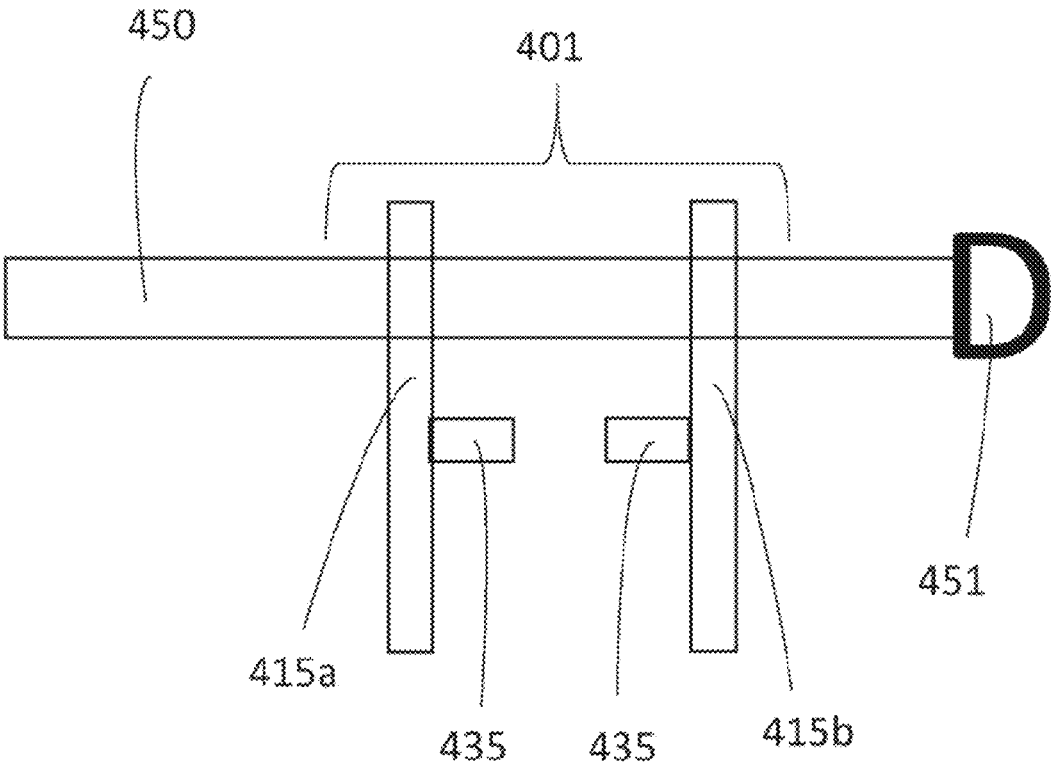
FIG. 6 illustrates an alternative strap apparatus embodiment for use in carrying an unwieldy object.

FIG. 6 illustrates an alternative strap apparatus embodiment 40 for use in carrying an unwieldy object. The strap apparatus 40 includes a first strap 415*a* and a second strap 415*b*. The "fulcrum" 401 refers to a middle section of the strap apparatus 40 that is positioned on the back of a user. The apparatus 40 also includes a third strap ("fulcrum strap") 450 which includes a loop fastener 451. The third strap 450 is affixed to the fulcrum 401 and can provide support to the unwieldy object 90. The first strap 415*a* and the second strap 415*b* can pass through the plurality of attachment points of the fulcrum 401.

Figure 7:
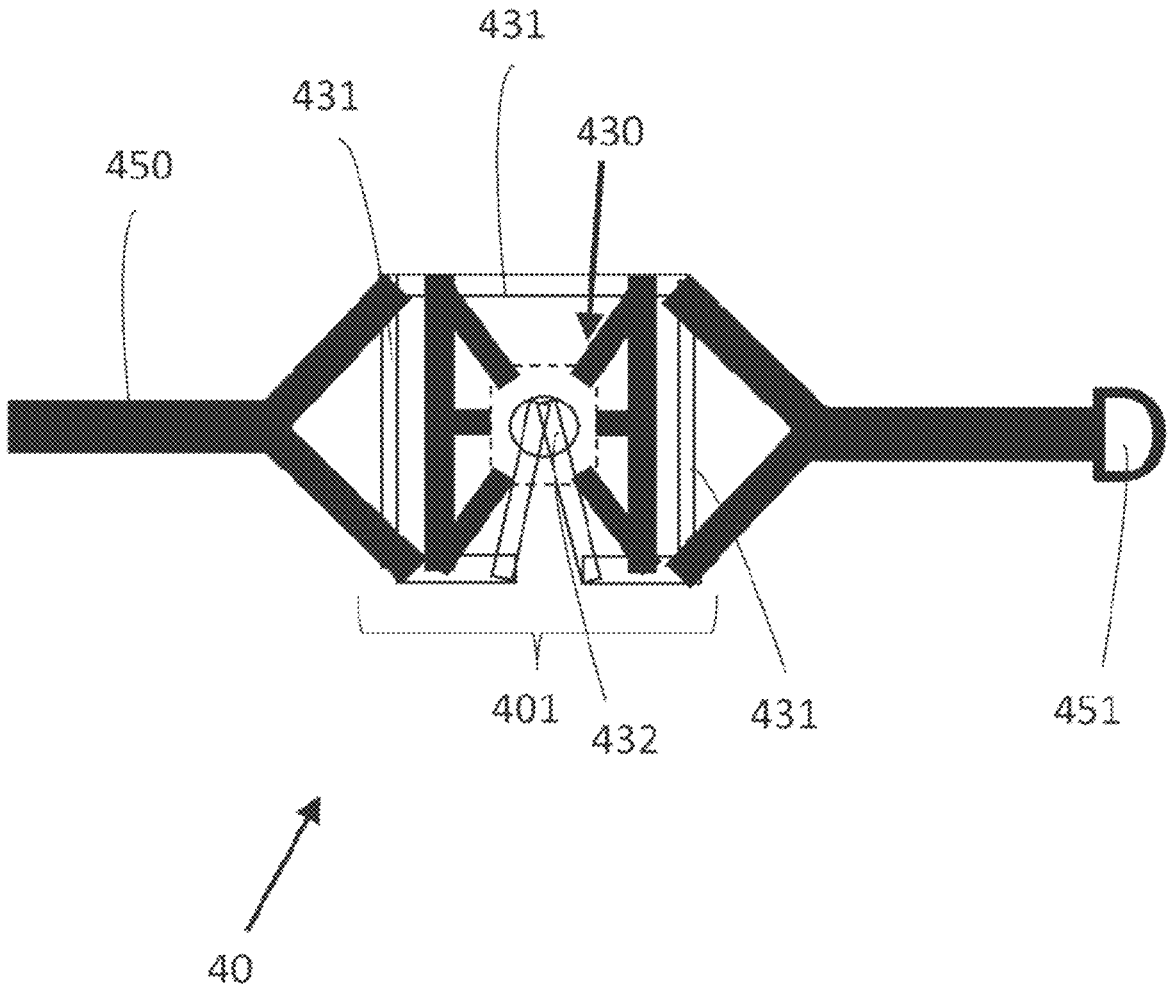
FIG. 7 illustrates the strap apparatus embodiment with a removable harness.

FIG. 7 illustrates the strap apparatus embodiment 40 with a removable harness 430. The strap apparatus 40 includes a fulcrum 401, a removable harness 430, and a plurality of attachment points. The fulcrum 401 is configured to be positioned on the back of a user 70. The removable harness 430 includes a female hitch receiver 431 and a male hitch 432. The male hitch 432 is configured to engage with the female hitch receiver 431 to secure the removable harness 430.

Figure 8A:
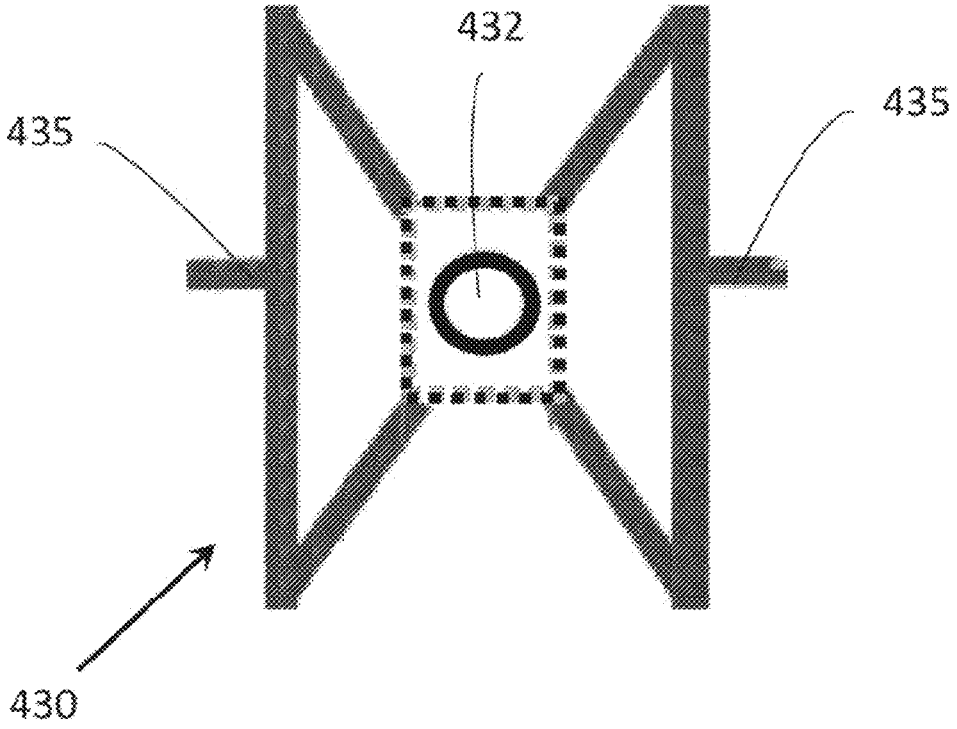
FIG. 8A illustrates a front view of the removable harness of the strap apparatus embodiment including a chest strap.

FIG. 8A illustrates a front view of the removable harness 430 of the strap apparatus embodiment 40 including a chest strap 435. The chest strap 435 can provide additional support for a user carrying an unwieldy object.

Figure 8B:
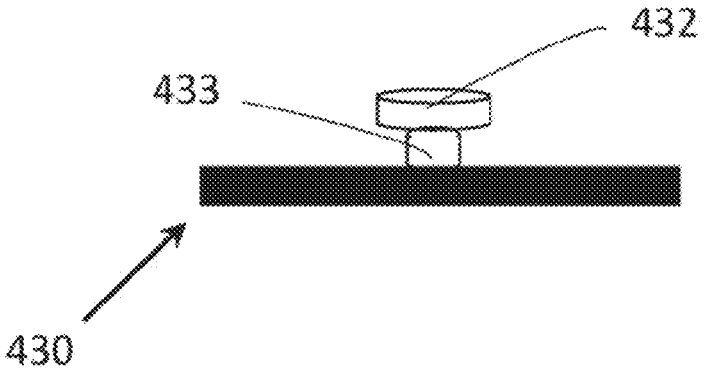
FIG. 8B illustrates a side view of the removable harness of the strap apparatus embodiment.

FIG. 8B illustrates a side view of the removable harness 430 of the strap apparatus embodiment 40. The male hitch 432 includes a hitch stem 433. The hitch stem 433 is preferably triangular in shape to prevent unwanted rotation of the hitch 432.

Figure 9:
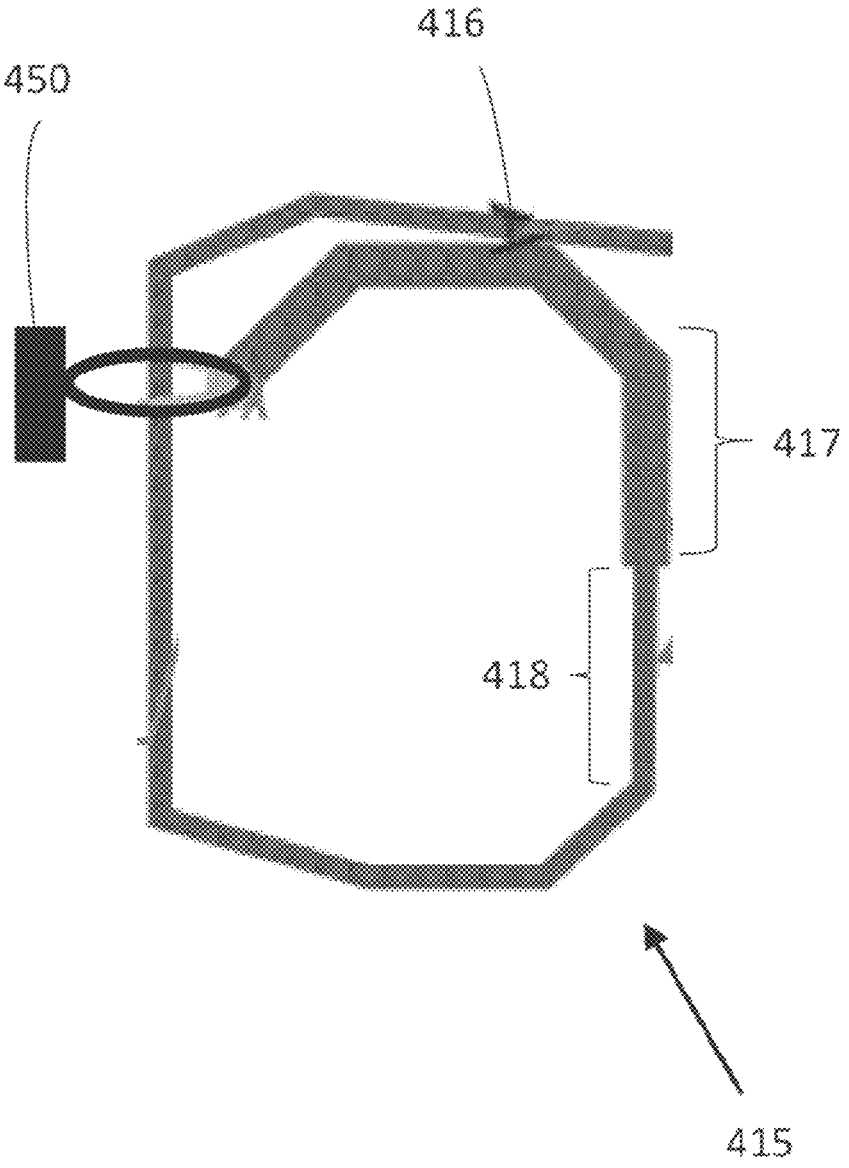
FIG. 9 illustrates a side view of a shoulder strap of the strap apparatus embodiment.

FIG. 9 illustrates a side view of a shoulder strap 415 of the strap apparatus embodiment 40. The first strap 415*a* and second strap 415*b* (collectively "shoulder straps" 415) can connect to the third strap 450 by means such as stitching or fasteners 416 (e.g. buckles or D-rings). The shoulder straps 415 can include a wider portion 417 and a narrower portion 418. The wider portion 417 can include foam and the narrower portion 418 can comprise a different material than the wider portion 417. The shoulder straps 415 are preferably made of a flexible material such as nylon or other polymers. Any straps disclosed in any of the example embodiments can be comprised of webbing, rope, polymers, or other suitable materials.

Figure 10:
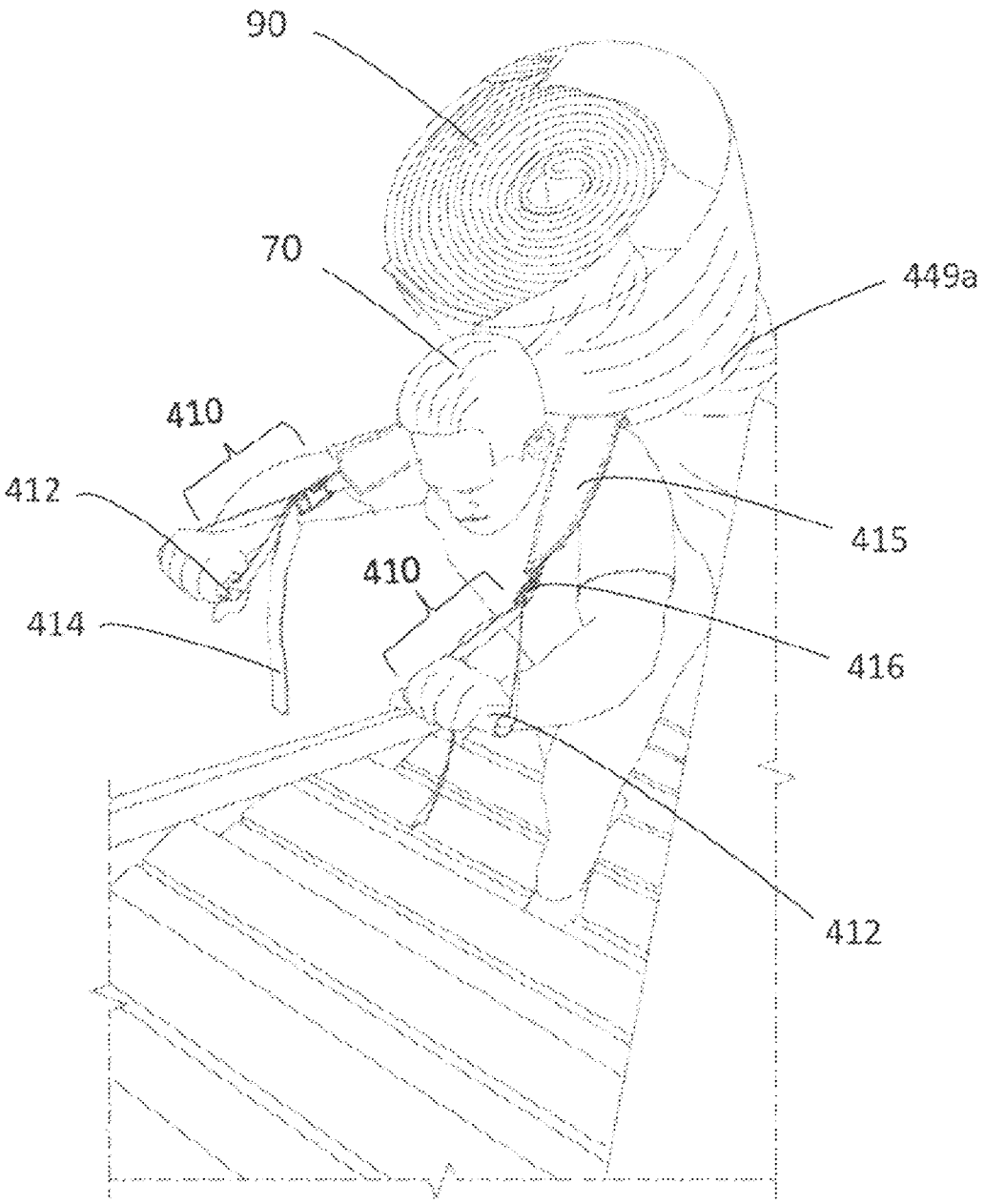
FIG. 10 illustrates a perspective view of a user employing the strap apparatus embodiment to carry an unwieldy object up a flight of stairs.

FIG. 10 illustrates a perspective view of a user 70 employing the strap apparatus embodiment 40 to carry an unwieldy object 90 up a flight of stairs. The user 70 holds the handle sections 410 using both hands for stability. Each handle section 410 can include a handle strap and a handle grip 412. A handle section 410 can be attached to a shoulder strap 415 by a plurality of means, including sewing, stitching, or using a mechanical fastener. In the illustrated example, the handle sections 410 are attached using buckle fasteners 416. A user can attach or detach a handle section 410 from a shoulder strap 415 by buckling or unbuckling the fastener 416. Further, a user can tighten or loosen a handle 410 by pulling on a handle strap.

In the example of FIG. 10, the user has a shoulder strap 415 over each of his shoulders. Shoulder straps 415 under tension can create uncomfortable pressure on a user's shoulders. Each shoulder strap 415 can have a shoulder pad affixed thereon to improve comfort to a user 70. The shoulder straps operatively connect to the fulcrum 401 that is positioned on the back of a user 70. The apparatus 40 also includes a third strap 450 (not visible) which includes a loop fastener 451. The third strap 450 is affixed to the fulcrum 401 and can provide support to the unwieldy object 90. The apparatus 40 can also include a cinch strap 449*a*. The cinch strap 449*a* is configured to be wrapped around the unwieldy object 90.

Figure 11:
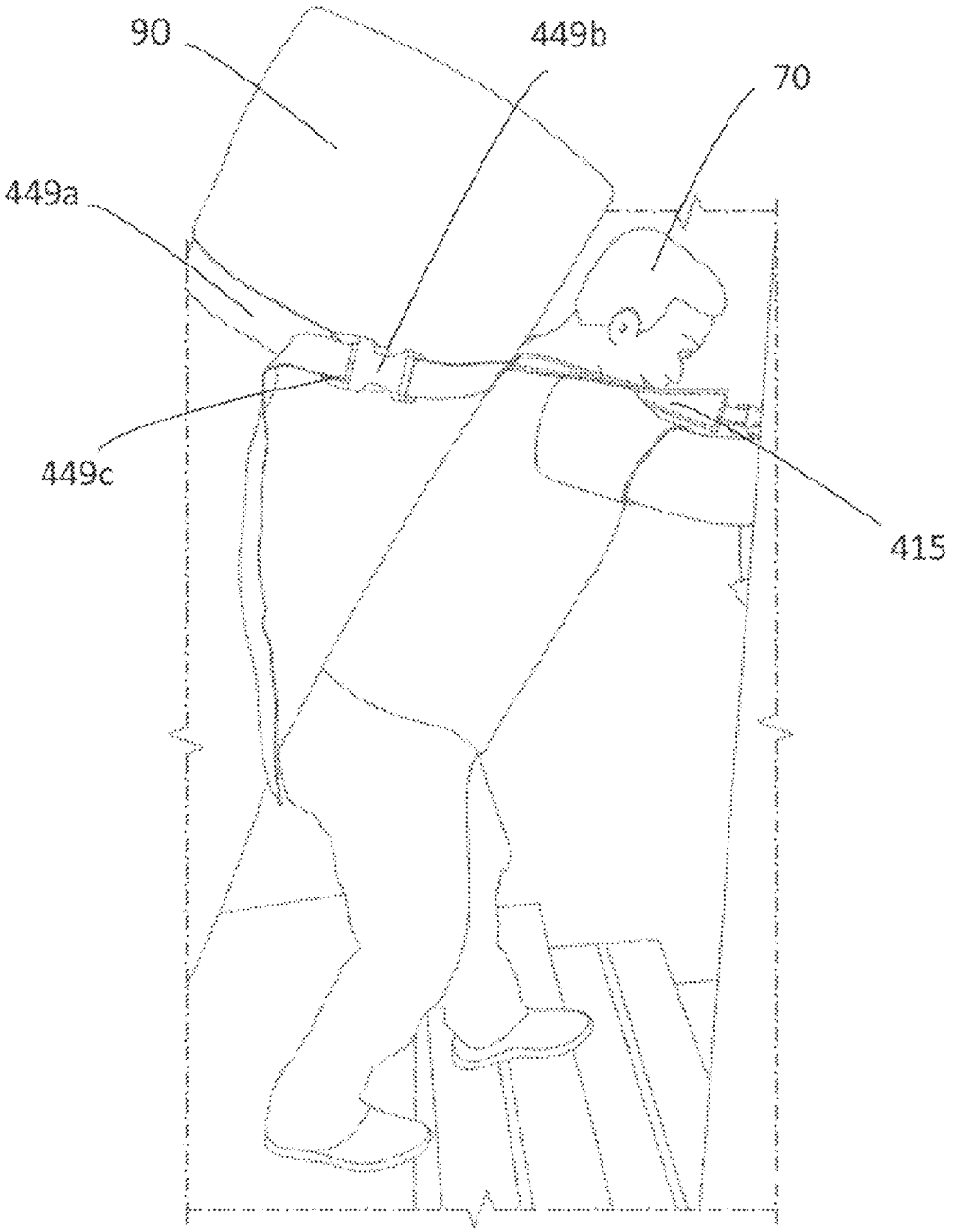
FIG. 11 illustrates a perspective view of a user employing the strap apparatus embodiment to carry an unwieldy object down a flight of stairs.

FIG. 11 illustrates a perspective view of a user 70 employing the strap apparatus embodiment 40 to carry an unwieldy object 90 down a flight of stairs. The apparatus 40 can include a cinch strap 449*a* with a hook fastener 449*b*. The hook fastener 449*b* of the cinch strap 449*a* can connect to the loop fastener 451 of the third strap 450 to secure the object 90. In further detail, the cinch strap 449*a* includes the hook fastener 449*b* stitched to it, runs through the cinch loop 449*c*, and is mechanically fastened (connected) to the third strap 450 with its loop fastener 451.

Figure 12:
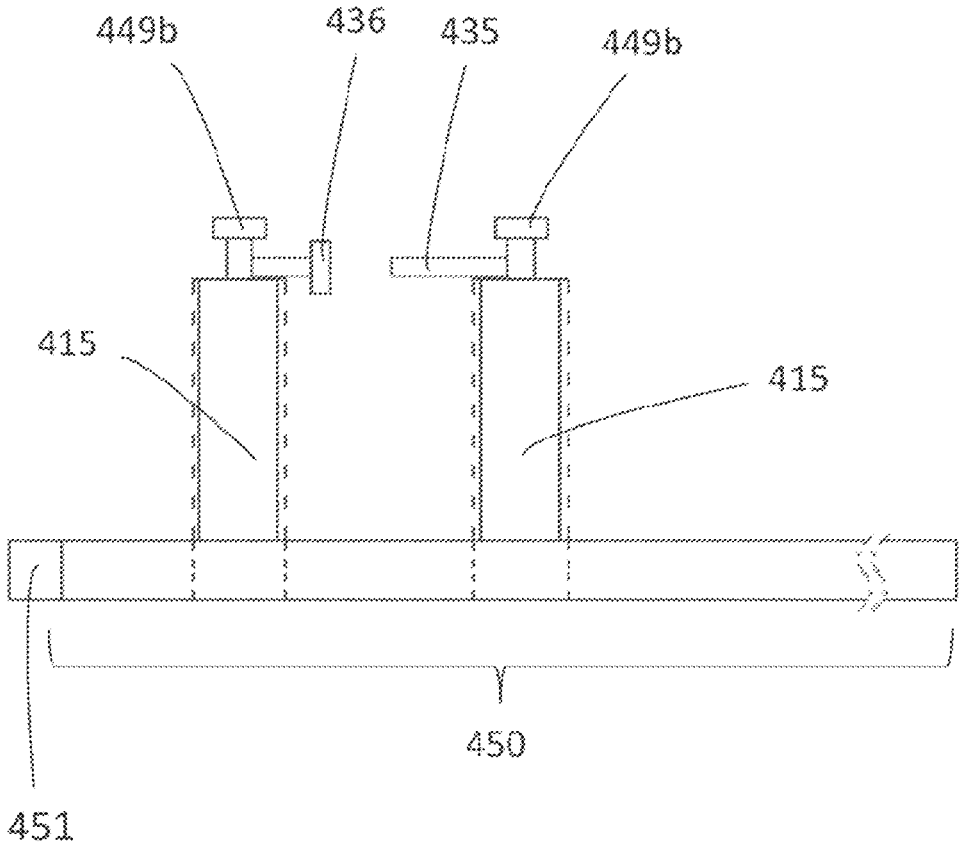
FIG. 12 illustrates a top view of the strap apparatus embodiment.

FIG. 12 illustrates a top view of the strap apparatus embodiment 40. The strap apparatus 40 can include shoulder straps 415 and shoulder pads affixed thereon. The shoulder straps 415 can be operatively connected to the third strap 450 by sewing them together, using mechanical fasteners, or other suitable means. Further, the strap apparatus 40 can include a chest strap 435 for providing additional support. The chest strap 435 can be secured across the chest of a user 70 by employing a fastener 436 to connect two ends of the strap 435 together.

Figure 13A:
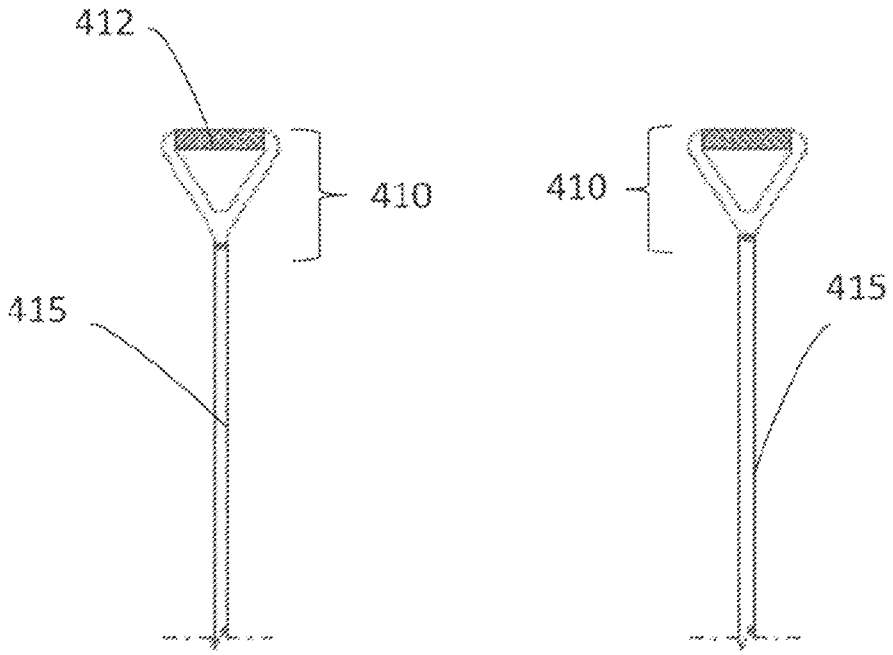
FIG. 13A illustrates two straps with handle sections for the strap apparatus embodiment.

FIG. 13A illustrates two straps 415 with handle sections 410 for the strap apparatus embodiment 40. As aforementioned, each handle section 410 can include a handle strap and a handle grip 412. A handle section 410 can be attached to a shoulder strap 415 by a plurality of means, including sewing, stitching, or using a buckle fastener. A user can attach or detach a handle section 410 from a shoulder strap by buckling or unbuckling a fastener. Further, a user can tighten or loosen a handle 410 by pulling on a handle strap.

Figure 13B:
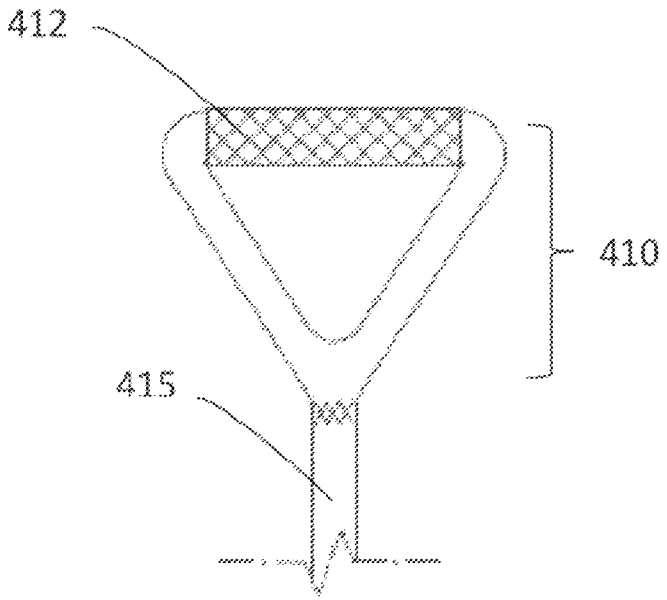
FIG. 13B illustrates a close up view of a handle section of the strap apparatus embodiment.

FIG. 13B illustrates a close up view of a handle section 410 of the strap apparatus embodiment 40. Each handle section 410 can include a handle grip 412 enabling a user 70 to better grasp and hold the strap apparatus 40. In the example shown in FIG. 13B, the handle section 410 is sewn to the shoulder strap 415.

The invention claimed is:

1. A strap apparatus for use in carrying an unwieldy object, the strap apparatus comprising:

a) a fulcrum comprising a removable harness and a plurality of attachment points;

b) the fulcrum is configured to be positioned on the back of a user;

c) a first strap and a second strap;

d) a third strap and a fourth strap;

g) each attachment point includes a webbing affixed to the fulcrum;

h) the first strap is affixed directly to a first attachment point;

i) the second strap is affixed directly to a second attachment point;

j) a first handle section affixed to the first strap;

k) a second handle section affixed to the second strap;

l) the first strap is configured to be positioned on a first shoulder of the user;

m) the second strap is configured to be positioned on a second shoulder of the user;

n) a cinch strap comprising a hook fastener;

o) a fulcrum strap comprising a loop fastener, wherein the fulcrum strap is affixed to the fulcrum;

p) the hook fastener of the cinch strap is mechanically connected to the loop fastener of the fulcrum strap; and q) wherein each of the straps are adjustable by the user.

2. The strap apparatus of claim 1, wherein:

c);

a) a pulley mechanism comprising two cross straps and a fastener connecting the cross straps;

b) the cross straps are affixed to the first strap and third strap;

c) wherein a user can use the fastener of the pulley mechanism to secure the cross straps across the user's chest;

d) each attachment point of the fulcrum further includes a D-ring connected to each webbing;

e) the first strap is affixed to a first D-ring; and f) the second strap is affixed directly to a second D-ring.

3. The strap apparatus of claim 1, wherein:

a) the removable harness further includes a chest strap; and b) the removable harness includes:

a female hitch receiver connected to the plurality of attachment points and the fulcrum strap;

a male hitch having a hitch stem; and the female hitch engages with the male hitch.

4. The strap apparatus of claim 1, wherein:

a) the first handle section is attached to the first strap using a mechanical fastener; and b) the second handle section is attached to the second strap using a mechanical fastener.

5. The strap apparatus of claim 4, wherein:

a) the first handle section includes a handle strap;

b) the second handle section includes a handle strap; and c) wherein each of the handle straps are adjustable by the user.

* * * * *